US011619899B2

(12) United States Patent
Tanaka et al.

(10) Patent No.: US 11,619,899 B2
(45) Date of Patent: Apr. 4, 2023

(54) PRINTER, CARTRIDGE, AND MEDIUM STORING PROGRAM TO BE INSTALLED IN PRINTER

(71) Applicant: BROTHER KOGYO KABUSHIKI KAISHA, Nagoya (JP)

(72) Inventors: Nobumasa Tanaka, Nagoya (JP); Tetsunori Mori, Kariya (JP); Ayaka Hotta, Kitanagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 79 days.

(21) Appl. No.: 17/196,086

(22) Filed: Mar. 9, 2021

(65) Prior Publication Data

US 2021/0302888 A1 Sep. 30, 2021

(30) Foreign Application Priority Data

Mar. 25, 2020 (JP) ..... JP2020-053552

(51) Int. Cl.
*B41J 2/175* (2006.01)
*G03G 15/00* (2006.01)

(52) U.S. Cl.
CPC ..... *G03G 15/5091* (2013.01); *B41J 2/17546* (2013.01)

(58) Field of Classification Search
CPC ..... B41J 2/17536; B41J 2/17546
See application file for complete search history.

(56) References Cited

U.S. PATENT DOCUMENTS 6,672,695 B1 * 1/2004 Naka ..... B41J 2/17546 347/7
2006/0256173 A1 * 11/2006 Tatsumi ..... B41J 2/17546 347/86
2010/0244501 A1 * 9/2010 Chiang ..... A47C 3/16 297/118

FOREIGN PATENT DOCUMENTS

JP 2017-56619 A 3/2017
JP 2017056619 A * 3/2017

* cited by examiner

*Primary Examiner* — Jason S Uhlenhake
(74) *Attorney, Agent, or Firm* — Merchant & Gould P.C.

(57) ABSTRACT

A printer includes: an installation case to which a cartridge having a first memory is installed, a printing unit which performs printing by using a print material supplied from the cartridge, a sensor which outputs a detection value according to an amount of the print material stored in the cartridge, a cartridge interface communicable with the first memory, a second memory, and a controller. The first memory stores cartridge information including: cartridge identification information and residual amount information according to the amount of the print material stored in the cartridge. The controller acquires the cartridge identification information and the residual amount information from the first memory, stores history information in the second memory, and updates the residual amount information of the history information based on information according to the amount of the print material discharged by the printing unit.

14 Claims, 6 Drawing Sheets

CTG REPLACING SCREEN

NOTIFICATION SCREEN

CONFIRMATION SCREEN

PRINTER, CARTRIDGE, AND MEDIUM STORING PROGRAM TO BE INSTALLED IN PRINTER

CROSS REFERENCE TO RELATED APPLICATION

The present application claims priority from Japanese Patent Application No. 2020-053552, filed on Mar. 25, 2020, the disclosure of which is incorporated herein by reference in its entirety.

BACKGROUND

Field of the Invention

The present invention relates to a printer, a cartridge, and a medium storing program to be installed in the printer.

Description of the Related Art

Japanese Patent Application Laid-open No. 2017-56619 discloses a printer using a reused or recycled cartridge to carry out printing. The recycled cartridge is, for example, a cartridge in which print material such as ink or toner is used up and which is replenished with a new print material thereafter.

In the printer disclosed in Japanese Patent Application Laid-open No. 2017-56619, the cartridge includes a memory. The memory stores the first installed date when the cartridge is first installed in the printer. Based on this first installed date, the printer determines whether or not the installed cartridge is a recycled cartridge.

SUMMARY

In a case that a user replenishes the cartridge with the print material, the user can recognize quality of the print material in the cartridge. However, if someone other than the user has replenished the cartridge with the print material, that is, if some person other than the user has reused the cartridge, then the user cannot recognize the quality of the print material in the cartridge. Depending on the quality of the print material, the printer may be at risk of malfunction.

An object of the present teaching is to provide a printer capable of restraining malfunction from occurring due to a recycled cartridge.

According to a first aspect of the present teaching, there is provided a printer including:

an installation case to which a cartridge having a first memory is installed;

a printing unit configured to perform printing by using a print material supplied from the cartridge installed in the installation case;

a sensor configured to output a detection value according to an amount of the print material stored in the cartridge installed in the installation case;

a cartridge interface configured to be communicable with the first memory;

a second memory; and a controller, wherein the first memory is configured to store cartridge information including: cartridge identification information for identifying the cartridge; and residual amount information according to the amount of the print material stored in the cartridge, wherein the controller is configured to:

acquire the cartridge identification information and the residual amount information from the first memory via the cartridge interface, store history information in the second memory, the history information including the cartridge identification information and the residual amount information associated with each other, and update the residual amount information of the history information based on information according to the amount of the print material discharged by the printing unit, and wherein in a case that the cartridge is installed in the installation case, the controller is configured to determine that the cartridge installed in the installation case is a proper recycled cartridge and update the residual amount information of the history information, based on:

a) determining that the second memory stores the history information having the same cartridge identification information as the cartridge identification information acquired from the first memory;

b) determining that the residual amount information is equal to or less than a threshold value stored in the second memory; and c) determining that the print material is stored in the cartridge installed in the installation case based on the detection value.

If no print material is stored in the cartridge according to the data but the sensor still detects that the print material is stored in the cartridge, then the controller determines that the cartridge installed in the installation case is a recycled cartridge refilled with the print material. Then, if the history information includes the cartridge identification information of the cartridge installed in the installation case, then the controller determines that the cartridge installed in the installation case is a proper recycled cartridge filled with the print material by a user. That is, it is possible for the controller to determine whether or not the cartridge installed in the installation case is a recycled cartridge and, moreover, a proper recycled cartridge to which the user has inputted the print material. Then, based on the determination of a proper recycled cartridge, the controller updates the residual amount information of the history information. That is, any improper recycled cartridges cannot be used in the printer because the residual amount information of the history information will not be updated. As a result, the printer according to the present teaching can restrain malfunction from happening due to cartridges recycled by others than the user.

According to a second aspect of the present teaching, there is provided a non-transitory medium storing a program to be installed in a printer comprising: an installation case to which a cartridge having a first memory is installed; a printing unit configured to perform printing by using a print material supplied from the cartridge installed in the installation case; a sensor configured to output a detection value according to an amount of the print material stored in the cartridge installed in the installation case; a cartridge interface configured to be communicable with the first memory; a second memory; and a controller, wherein the first memory is configured to store cartridge information including: cartridge identification information for identifying the cartridge; and residual amount information according to the amount of the print material stored in the cartridge, the program, when executed by the controller, causing the printer to:

store history information in the second memory, the history information including the cartridge identification information and the residual amount information associated with each other, the cartridge identification information and the residual amount information being acquired from the first memory via the cartridge interface;

specify new residual amount information based on the residual amount information and information according to the amount of the print material discharged by the printing unit; and update the residual amount information of the history information with the new residual amount information, and wherein in a case that the cartridge is installed in the installation case, the program causes the printer to determine that the cartridge installed in the installation case is a proper recycled cartridge and to update the residual amount information of the history information, based on:

a) determining that the second memory stores the history information having the same cartridge identification information as the cartridge identification information acquired from the first memory;

b) determining that the residual amount information is equal to or less than a threshold value stored in the second memory; and c) determining that the print material is stored in the cartridge installed in the installation case based on the detection value.

According to a third aspect of the present teaching, there is provided a cartridge in which print material is stored and which is installable to a printer provided with a sensor, the cartridge comprising:

a memory; and a detection object configured to change a state thereof, such that a detection value by the sensor is changed between a case in which an amount of the print material stored in the cartridge is equal to or more than a predetermined amount and a case in which the amount of the print material stored in the cartridge is less than the predetermined amount, wherein the memory is configured to store cartridge identification information, residual amount information, and marking information are stored, the cartridge identification information being used to identify the cartridge, the residual amount information indicating the amount of the print material stored in the cartridge, the marking information indicating that the cartridge is a recycled cartridge, the residual amount information is determined according to the amount of the print material stored in the cartridge, and the marking information is determined based on the state of the detection object, the cartridge identification information, and the residual amount information.

DESCRIPTION OF THE EMBODIMENT

A preferred embodiment of the present teaching will be explained below. Note that needless to say, the embodiment explained below is merely one example of the present teaching, and it is possible to appropriately change or modify the embodiment of the present teaching without departing from the true scope and spirit of the present teaching. For example, it is possible to appropriately change the order of carrying out each process to be described later on without departing from the true scope and spirit of the present teaching. Alternatively, it is possible to appropriately omit part of the aftermentioned processes without departing from the true scope and spirit of the present teaching.

Figure 1B:
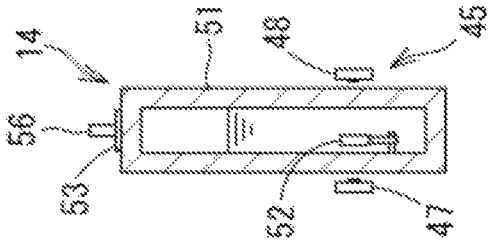
FIG. 1A is a schematic cross-section view of a printer according to an embodiment of the present teaching and FIG. 1B is a schematic cross-section view of a cartridge installed in an installation case.
Figure 1A:
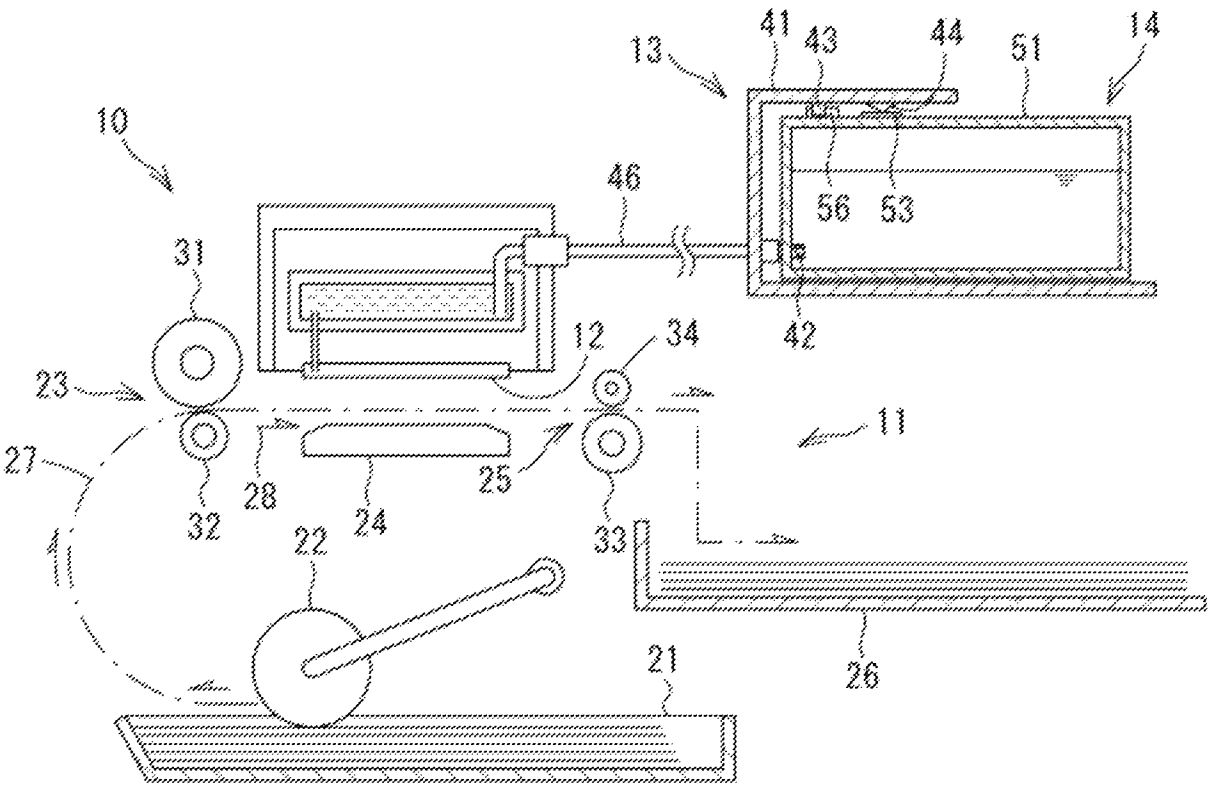

In this embodiment, explanation will be made on a printer 10 depicted in FIG. 1A. The printer 10 is used with an installed cartridge(s) 14 storing a print material. The print material is an ink, a toner, or the like. That is, the printer 10 is a so-called ink jet printer, a laser printer, or the like. Further, the cartridge(s) 14 installed in the printer 10 may be one or more than one cartridges. That is, the printer 10 may be a so-called monochrome printer or a color printer. Furthermore, the printer 10 may be a so-called multifunction device having a scanner function, a photocopy function, and/or a facsimile function, in addition to the printer function. In the following explanation, an example will be taken where the printer 10 is supposed to be a color printer and an ink jet printer.

The printer 10 includes a conveyance device 11 for conveying a sheet of (printing medium), a head 12 for carrying out printing by jetting ink droplets onto the sheet conveyed there, and an installation case unit 13. The cartridge 14 storing the ink to be supplied to the head 12 is installed in the installation case unit 13.

The conveyance device 11 has a paper feed tray 21, a feeding roller 22, a conveyance roller pair 23, a platen 24, a paper discharge roller pair 25, a paper discharge tray 26, an unshown guide member defining a conveyance path 27.

The paper feed tray 21 is a tray holding sheets before images are printed thereon. The feeding roller 22 is to send out the sheets held on the paper feed tray 21 to the conveyance path 27. The conveyance roller pair 23 has a conveyance roller 31 and a driven roller 32 to nip and convey the sheets sent out by the feeding roller 22 to the conveyance path 27. The paper discharge roller pair 25 is positioned downstream according to a conveyance direction 28 for the conveyance roller pair 23 to convey the sheets therealong. The paper discharge roller pair 25 has a paper discharge roller 33 and a driven roller 34 to nip and convey the sheets.

The platen 24 is positioned between the conveyance roller pair 23 and the paper discharge roller pair 25 in the conveyance direction 28. The platen 24 is a member supporting the sheet conveyed by the conveyance roller pair 23 or the paper discharge roller pair 25.

The paper discharge tray 26 is positioned downstream from the paper discharge roller pair 25 in the conveyance direction 28. The paper discharge tray 26 holds the sheets discharged from the platen 24 by the paper discharge roller pair 25.

The head 12 is positioned above the platen 24 to face the platen 24. The head 12 defines the conveyance path 27 with the platen 24.

The head 12 is a device for jetting ink droplets onto the sheet supported on the platen 24 to print an image on the sheet. The head 12 may be fixed above the platen 24 or be held on a movable carriage in a direction orthogonal to the conveyance direction 28 (a direction orthogonal to the page of FIGS. 1A and 1B). Further, the head 12 may have piezoelectric elements to which a pressure will be applied to jet the ink, or have a heater for explosive boil or bumping of the ink to jet the same. That is, the head 12 may be of any kind of heads. The head 12 is an example of the printing unit.

The installation case unit 13 includes an installation case 41, ink needles 42, installation sensors 43, cartridge interfaces (to be referred to below as cartridge I/F) 44, and liquid level sensors 45. The liquid level sensors 45 are an example of the sensor.

The installation case 41 is a member holding four cartridges 14 in a removable manner. The four cartridges 14 are the cartridge 14 storing the cyan ink, the cartridge 14 storing the magenta ink, the cartridge 14 storing the yellow ink, and the cartridge 14 storing the black ink.

The installation case 41 is, for example, a resin molding product formed in a box-like shape having an opening and being hollow inside. Each cartridge 14 is installed in the installation case 41 by being inserted into the installation case 41 through the opening. Further, each cartridge 14 can be removed from the installation case 41 through the opening.

The installation case 41 holds the four ink needles 42. Each of the ink needles 42 projects from the inner surface of the installation case 41. If any of the cartridges 14 is installed into the installation case 41, then the corresponding ink needle 42 is inserted through an unshown insertion hole of the cartridge 14. That is, the leading ends of the ink needles 42 are positioned in the cartridges 14 installed in the installation case 41. The inks stored in the cartridges 14 can flow out of the cartridges 14 passing internally through the ink needles 42.

Each of the ink needles 42 is connected to an end of one of four tubes 46. The other end of each tube 46 is connected with the head 12. That is, the inks of the colors of cyan, magenta, yellow and black flowing out of the four cartridges 14 are supplied to the head 12 passing internally through the four tubes 46, respectively.

The installation sensors 43 detect whether or not the cartridges 14 are installed in the installation case 41, and whether or not the cartridges 14 are removed from the installation case 41. The four installation sensors 43 are fitted on the installation case 41.

Each of the installation sensors 43 is, for example, a photo interrupter having a light emitting diode and a photo diode facing each other. The installation sensor 43 outputs a detection signal at different voltage value (detection value) between the cases of presence and absence of an aftermentioned detection rib 56 of the cartridge 14 in the optical path where the light emitting diode radiates light. An aftermentioned control program 68 determines whether or not the cartridge 14 is installed in the installation case 41 and whether or not the cartridge 14 is removed from the installation case 41, on the basis of the detection value outputted by the installation sensor 43 or a change in the detection value. Note that the installation sensor 43 may be a mechanical switch such as a micro switch, a tact switch or the like having a presser portion to be pressed by the cartridge 14 installed in the installation case 41.

The cartridge I/F 44 is an electrode in contact with an electrode 54 of an IC chip 53 of the cartridge 14. Alternatively, the cartridge I/F 44 may be an antenna capable of transceiving of electric waves. Still alternatively, the cartridge I/F 44 may be a light emitting diode or a photo diode. That is, the cartridge I/F 44 is an interface for communication via an electrode or communication via electric waves, light or the like, with the aftermentioned IC chip 53 of the cartridge 14. In the example depicted in FIG. 1A, the cartridge I/F 44 is an electrode. Four cartridges I/F 44 are fitted respectively on the installation case 41.

The liquid level sensor 45 is a sensor for detecting whether the ink residual amount, which is the ink amount stored by the cartridge 14, is not less than or less than a predetermined amount. Four liquid level sensors 45 are provided respectively on the installation case 41.

The liquid level sensor 45 is, for example, a photo interrupter having a light emitting diode 47 and a photo diode 48 facing each other. The light emitting diode 47 and the photo diode 48 are held by the installation case 41. The cartridge 14 installed in the cartridge 14 has a float 52 which ascends or descends according to the ink level. The float 52 is positioned in the optical path of the light emitting diode 47 if the ink residual amount is not less than the predetermined amount but departs from the optical path of the light emitting diode 47 if the ink residual amount is less than the predetermined amount. That is, the liquid level sensor 45 outputs a different detection value between the case where the ink residual amount is not less than the predetermined amount and the case where the ink residual amount is less than the predetermined amount. The aftermentioned control program 68 determines whether the ink residual amount is not less than the predetermined amount or the ink residual amount is less than the predetermined amount on the basis of the detection value outputted by the liquid level sensor 45. Note that the liquid level sensor 45 may be a sensor of any kind of configuration as far as the sensor outputs a different detection value between the case where the ink residual amount is not less than the predetermined amount and the case where the ink residual amount is less than the predetermined amount. The light emitting diode 47 is an example of the light emitting unit. The photo diode 48 is an example of the light receiving unit.

The cartridge 14 includes a box-like case 51 being shallow and internally hollow, the float 52 arranged in the case 51, and the IC chip 53 fitted on the outer surface of the case 51.

The case 51 stores an ink. Further, the case 51 is a resin molding product made of resin being light transmittable. That is, the light radiated by the light emitting diode 47 of the liquid level sensor 45 transmits through the case 51.

The case 51 has the detection rib 56 projecting from the outer surface. The detection rib 56 is provided at a position on the optical path of the light radiated by the light emitting diode of the installation sensor 43, with the cartridge 14 being installed in the installation case 41. Alternatively, the detection rib 56 is provided to pass through the above optical path when the cartridge 14 is installed into the installation case 41 or when the cartridge 14 is removed from the installation case 41. That is, the detection rib 56 changes the detection value outputted by the installation sensor 43 when the cartridge 14 is installed into or removed from the installation case 41.

The float 52 is pivotally held by the case 51. The specific gravity of the float 52 is smaller than that of the ink stored by the case 51. That is, the float 52 is floating on the ink. The float 52 pivots according to descending of the ink level due to the change from the ink residual amount being not less than the predetermined amount to being less than the predetermined amount. In the pivot movement, the float 52 moves from a shading position on the optical path of the light radiated by the light emitting diode 47 of the liquid level sensor 45, to a retracting position departing from the optical path. That is, the float 52 is either in the shading position if the ink residual amount is not less than the predetermined amount, or in the retracting position if the ink residual amount is less than the predetermined amount. The float 52 changes the detection value outputted by the liquid level sensor 45 between the case where the ink residual amount is not less than the predetermined amount and the case where the ink residual amount is less than the predetermined amount. The aftermentioned control program 68 determines whether the ink residual amount is not less than the predetermined amount or less than the predetermined amount according to the detection value outputted by the liquid level sensor 45 or the change of the detection value. The float 52 is an example of the detected body.

The cartridge 14 may have a prism instead of the float 52. The prism is arranged in the case 51. The prism is a member where light is either transmitted therethrough or reflected therefrom, depending on whether or not it is soaked in the ink. In the prism, the part with the incident light radiated by the light emitting diode 47 of the liquid level sensor 45 is either soaked in the ink if ink residual amount is not less than the predetermined amount, or not soaked in the ink if ink residual amount is less than the predetermined amount. Being not soaked in the ink, the prism leads the light radiated by the light emitting diode 47 to the photo diode 48 or, being soaked in the ink, the prism leads the light radiated by the light emitting diode 47 elsewhere than the photo diode 48. That is, the prism varies the detection value outputted by the liquid level sensor 45 between the case where the ink residual amount is not less than the predetermined amount and the case where the ink residual amount is less than the predetermined amount. The prism is another example of the detected body.

Figure 2:
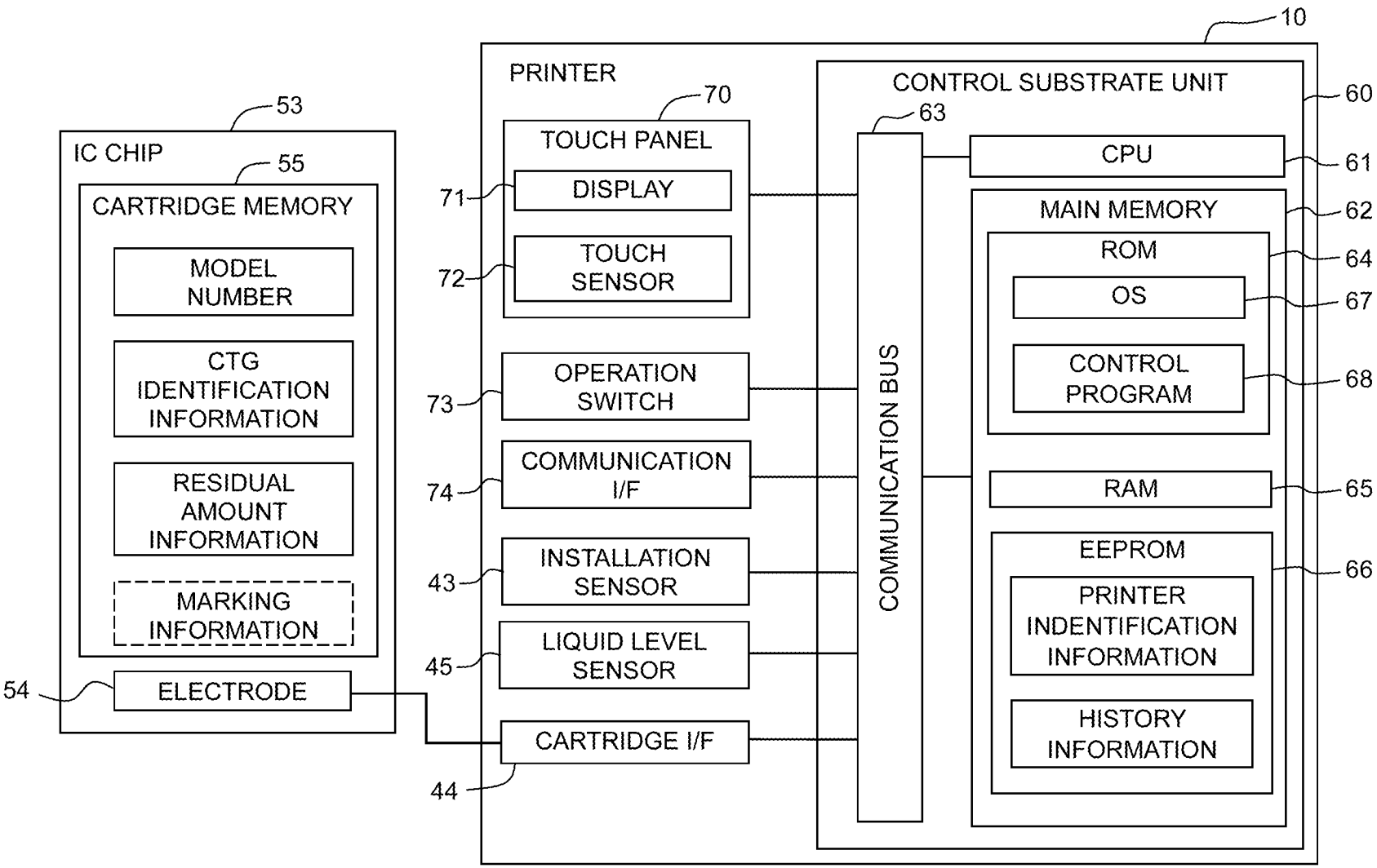
FIG. 2 is a functional block diagram of the printer.

As depicted in FIG. 2, the IC chip 53 has a CTG memory 55, and the electrode 54 in contact with the cartridge I/F 44 which is the electrode of the installation case unit 13, when the cartridge 14 is installed in the installation case 41. "CTG" is the abbreviation of "cartridge". The IC chip 53 communicates with the aftermentioned control program 68 via the electrode 54. Note that the IC chip 53 may have an antenna or a light emitting diode and a light receiving diode, instead of the electrode 54. The CTG memory 55 is an example of the first memory.

The CTG memory 55 stores a model number, CTG identification information, and residual amount information.

The model number is the information stored in the CTG memory 55, being determined by the manufacturer according to, for example, the ink color stored by the cartridge 14, the ink type such as a water soluble ink, a solvent ink or the like, the size such as a normal size, a large volume size or the like, etc.

The CTG identification information is, for example, a serial number rendering information to identify the cartridge 14 individually.

The residual amount information shows the ink residual amount stored by the cartridge 14. If the cartridge 14 is unused, then the CTG memory 55 stores full residual amount information as the residual amount information. The residual amount information is updated by the control program 68 each time the printer 10 carries out printing. The detail about that will be described later on.

The CTG memory 55 has a storage area where marking information is stored. The marking information shows whether or not the cartridge 14 is a proper recycled cartridge. The aftermentioned control program 68 causes the CTG memory 55 to store the marking information. The marking information is all or part of printer identification information comprised of words and/or numbers. For example, the marking information is the last digit of the aftermentioned printer identification information. A description will be made later on about the timing for the CTG memory 55 to store the marking information.

The printer 10 further includes a control substrate unit 60, a touch panel 70 with an operation switch 73, and a communication interface (to be referred to below as communication I/F) 74.

The touch panel 70 has a display 71, and a transparent plate-like touch sensor 72 superimposed on the display 71. The display 71 displays a screen according to inputted screen data. The touch sensor 72 outputs position information indicating the position having been touched. The aftermentioned control program 68 determines whether or not a user has selected an icon or the like displayed on the display 71 on the basis of the position information outputted by the touch sensor 72.

The operation switch 73 is, for example, a mechanical switch such as a micro switch, a tact switch, or the like. The operation switch 73 accepts the user's instructions. Note that if only the touch panel 70 can accept the user's instructions, then the operation switch 73 may not be provided. The touch sensor 72 and the operation switch 73 are an example of the input interface.

The communication I/F 74 is an interface for communication with other devices with wires or wirelessly. Wired LAN or the like may be applied as means of communication with wires. Wireless LAN such as WiFi or the like, Bluetooth (registered trademark), or the like may be applied as means of wireless communication. The printer 10 carries out communications with personal computers, servers and the like via the communication I/F 74. The printer 10 carries out printing, for example, after acquiring print data and printing instruction from a personal computer via the communication I/F 74.

The control substrate unit 60 includes a CPU 61, a main memory 62, and a communication bus 63. The control substrate unit 60 is, for example, realized by a microcomputer, ICs, resistances, capacitors, diodes and the like which are all mounted on a patterned circuit substrate.

The CPU 61 is a central processing unit for executing an aftermentioned OS 67 and the control program 68. The CPU 61 executes the OS 67 and the control program 68 in a quasi-parallel manner by way of, for example, multitask processing. The CPU 61 is an example of the controller.

The main memory 62 has a ROM 64, a RAM 65, an EEPROM 66, buffer memories of the CPU 61, and the like. The main memory 62 may include portable storage media such as a USB memory and the like installed in an unshown slot of the printer 10. The main memory 62 is an example of the second memory.

The ROM 64 stores the OS 67 which is an operating system, and the control program 68 for controlling the drive of the conveyance device 11 and the head 12, etc. Note that all or part of the OS 67 and the control program 68 may be stored in the EEPROM 66. The control program 68 is an example of the program.

The RAM 65 is used to execute the OS 67 and the control program 68. Further, the RAM 65 temporarily stores data and information when the OS 67 and/or the control program 68 are/is executed.

The EEPROM 66 stores the printer identification information in advance. The printer identification information is comprised of a serial number, an MAC address and the like to identify the printer 10 individually.

Further, the EEPROM 66 has a storage area for storing history information. The control program 68 causes the EEPROM 66 to store the history information. The history information is information associated with the model number of the cartridge 14 installed in the printer 10, the CTG identification information, the residual amount information, the installed date, and the like. The installed date shows the date when the cartridge 14 is installed into the installation case 41.

Further, the EEPROM 66 or the ROM 64 stores unshown screen data. The screen data presents a home screen for the display 71 to display, an aftermentioned CTG replacing screen, a notification screen, a confirmation screen (FIGS. 5A to 5C), and the like.

The CPU 61 and the main memory 62 are connected with the communication bus 63. That is, the OS 67 and the control program 68 stored in the main memory 62 can be executed by the CPU 61 via the communication bus 63. Then, the control program 68 can read out the information and data stored in the main memory 62 via the communication bus 63 and, on the other hand, can cause the main memory 62 to store information and data.

Further, the touch panel 70, the operation switch 73, the communication I/F 74, the installation sensor 43, and the liquid level sensor 45 are connected with the communication bus 63 via unshown cables. That is, the control program 68 can display the home screen and other screens on the display 71 to which image data are inputted, can acquire the user's inputs via the touch sensor 72 and the operation switch 73, can send and receive information and data via the communication I/F 74, and can acquire the detection signals outputted by the installation sensor 43 and the liquid level sensor 45.

Hereinbelow, referring to FIG. 3A to FIG. 4C, an explanation will be made on processes executed by the CPU 61 in accordance with the control program 68. In the following explanation, the processes executed by the CPU 61 in accordance with the control program 68 are described as processes executed by the control program 68.

The control program 68 determines whether or not a print instruction is inputted (S11). The print instruction is, for example, inputted from a personal computer via the communication I/F 74 or inputted from the touch sensor 72 by way of the user's selection of the print icon, the photocopy icon, or the like.

If the control program 68 determines that no print instruction is inputted (S11: No), then the process is ended. Note that the control program 68 carries out the step S11 periodically at predetermined intervals to determine whether or not the print instruction is inputted. The predetermined intervals are stored in the main memory 62.

If the control program 68 determines that the print instruction is inputted (S11: Yes), then it determines whether or not an empty flag is turned on (S12). The empty flag is, for example, a value of "0" or "1" stored in the EEPROM 66 of the main memory 62. The EEPROM 66 has in advance a storage area for storing the empty flag. Further, the empty flag is turned on in the step S21 (FIG. 3C), and turned on only if there is no sufficient ink amount for carry out printing. That is, in the step S12, the control program 68 determines whether or not there is a sufficient ink amount for carrying out printing. Note that the empty flag is set for each of the four inks of cyan, magenta, yellow and black. In the step S12, the control program 68 determines that no empty flag is turned on (S12: No) under the condition that all of the four empty flags are turned off. Otherwise, even if just one empty flag is turned on, it determines that the empty flag is turned on (S12: Yes). The empty flag turned on is an example of the specific information.

If the control program 68 determines that the empty flag is turned off (S12: No), then as depicted in FIG. 3C, it carries out a printing process on one page (S13). In particular, the control program 68 drives the conveyance device 11 and the head 12 on the basis of the print data, to print the image on the sheet (of paper).

Further, the control program 68 carries out the printing process while counting a value according to the ink droplet amount jetted by the head 12 in the printing process. For example, the control program 68 counts how many times the piezoelectric elements or heaters of the head 12 have been driven. This counting is carried out according to each of the four color inks. The counted value is used to calculate a new residual amount. The detail thereof will be explained in the aftermentioned step S15. The counted value is an example of the "information according to the amount of the print material discharged by the printing unit".

The control program 68 determines whether or not there is a change in the detection value outputted by the liquid level sensor 45 (S14) after carrying out the printing process (S13). That is, the control program 68 determines in the step S14 whether or not the ink residual amount stored in the cartridge 14 has changed from being not less than the predetermined amount to being less than the predetermined amount. To be explained in detail, carrying out the printing process causes the ink residual amount to decrease. If the ink residual amount before the decrease is not less than the predetermined amount and the ink residual amount after the decrease is less than the predetermined amount, then the detection value outputted by the liquid level sensor 45 changes accordingly. The control program 68 determines whether or not the ink residual amount has changed from being not less than the predetermined amount to being less than the predetermined amount by way of seeing whether the detection value has changed.

If the control program 68 determines that the ink residual amount has not changed from being not less than the predetermined amount to being less than the predetermined amount (S14: No), then it calculates new information of the residual amount on the basis of the aforementioned counted value and the residual amount information contained in the history information (S15). In particular, the control program 68 subtracts the counted value from the residual amount indicated by the residual amount information of the history information, to calculate the new residual amount.

The control program 68 updates the residual amount information of the history information with the calculated residual amount (S16). That is, each time printing is carried out, the residual amount information of the history information is updated.

On the other hand, if the control program 68 determines that the ink residual amount has changed from being not less than the predetermined amount to being less than the predetermined amount due to the printing process (S14: Yes), then it updates the residual amount information of the history information with a predetermined amount stored beforehand in the main memory 62 (S17). To be explained in detail, the aforementioned counted value contains some error. Therefore, if printing is repeated, then the error will be accumulated. The step S17 is to reset the error contained in the residual amount information by updating the ink residual amount indicated by the residual amount information of the history information with the "predetermined amount" if the ink residual amount has changed from being not less than the predetermined amount to being less than the predetermined amount.

Note that the residual amount information of the history information is used to display the ink residual amount. Although not depicted in the flow chart, the control program 68 causes the display 71 to display the ink residual amount indicated by the residual amount information. That is, the residual amount information of the history information is updated each time printing is carried out, and thereby the ink residual amount displayed on the display 71 is also updated each time printing is carried out.

Next, the control program 68 determines whether or not the cartridge 14 installed in the cartridge 14 is a recycled cartridge (S18). The recycled cartridge refers to a cartridge which was a cartridge 14 using up the stored ink and to which the ink has been inputted anew. The control program 68 determines whether or not each of the four cartridges 14 is a recycled cartridge. A description will be made later on about the detail of determining whether or not a cartridge is a recycled one.

If the control program 68 determines that the cartridge 14 installed in the installation case 41 is not a recycled cartridge (S18: No), then it updates the residual amount information stored in the CTG memory 55 with the residual amount information updated in the step S16 or S17 (S19). If the control program 68 determines that the cartridge 14 installed in the installation case 41 is a recycled cartridge (S18: Yes), then the step S19 is skipped. That is, if the cartridge 14 installed in the installation case 41 is a recycled cartridge, then the residual amount information stored in the CTG memory 55 is not updated but kept as it is, being the residual amount information of the case where the ink is used up (zero, for example). On the other hand, if the cartridge 14 installed in the installation case 41 is not a recycled cartridge, then the residual amount information stored in the CTG memory 55 is updated each time printing is carried out. Then, if the ink is used up, then the residual amount information stored in the CTG memory 55 shows that, for example, the residual amount is zero. The step S18 is carried out for each of the four cartridges 14 to determine whether or not to update the residual amount information.

Next, the control program 68 determines whether or not there is sufficient ink residual amount for carrying out printing (S20). In particular, the control program 68 determines whether or not the ink residual amount exceeds a threshold value, the ink residual amount being indicated by the residual amount information which is contained in the history information and updated in the step S16. The threshold value is stored in the main memory 62 beforehand. If the ink residual amount exceeds the threshold value, then the control program 68 determines that the ink residual amount is sufficient for carrying out printing (S20: Yes). If the ink residual amount does not exceed the threshold value, then the control program 68 determines that the ink residual amount is not sufficient for carrying out printing (S20: No). The determination of the step S20 is carried out for each of the four cartridges 14. That is, whether or not there is a sufficient ink residual amount is determined for each of the four color inks.

If the control program 68 determines that there is not a sufficient ink residual amount for carrying out printing (S20: No), then it turns on the empty flag (S21). The empty flag is turned on to disallow carrying out the printing process. If the control program 68 determines that there is a sufficient ink residual amount for carrying out printing (S20: Yes), then the step S21 is skipped.

Next, the control program 68 determines whether or not there is a following page indicated by the print data (S22). If the control program 68 determines that there is no following page (S22: No), then the process is ended. On the other hand, if the control program 68 determines that there is a following page (S22: Yes), then as depicted in FIG. 3A, it determines whether or not the empty flag is turned on (S12).

Figure 4A:
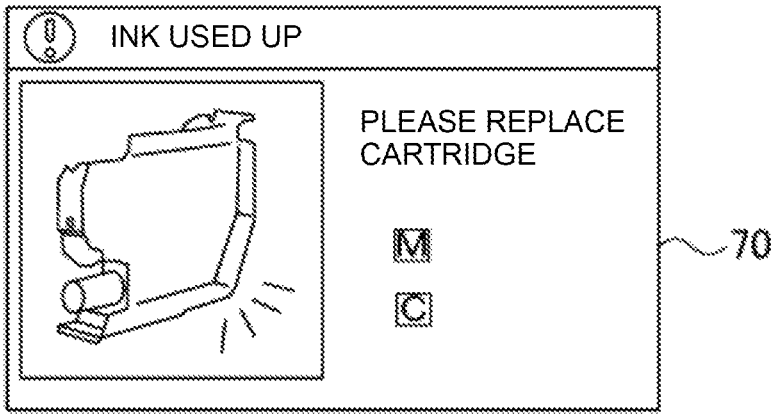
FIG. 4A depicts a cartridge replacing screen.

If the control program 68 determines that the empty flag is turned on (S12: Yes), then it causes the display 71 to display the CTG replacing screen (S23). The CTG replacing screen has, as depicted in FIG. 4A, the message "INK USED UP.", the message "PLEASE REPLACE CARTRIDGE.", and a letter indicating the color of the ink which was stored in the cartridge 14 and is now used up. In the illustrated example, the letter "M" indicating the ink of the magenta color and the letter "C" indicating the ink of the cyan color are displayed on the CTG replacing screen, as the colors of the relevant inks. According to the CTG replacing screen, the user removes the cartridges 14 whose inks are used up from the installation case 41. Then, the user installs new cartridges 14 storing the relevant inks into the installation case 41. Alternatively, the user may input the inks to the cartridges 14 removed from the installation case 41 and then install the recycled cartridges, i.e., the cartridges 14 with the inputted inks, into the installation case 41. Note that in the following explanation, the expression "The cartridge 14 is replaced" will be used, too, to refer to the case where the user reinstalls the recycled cartridge with the ink inputted into the installation case 41.

Figure 3A:
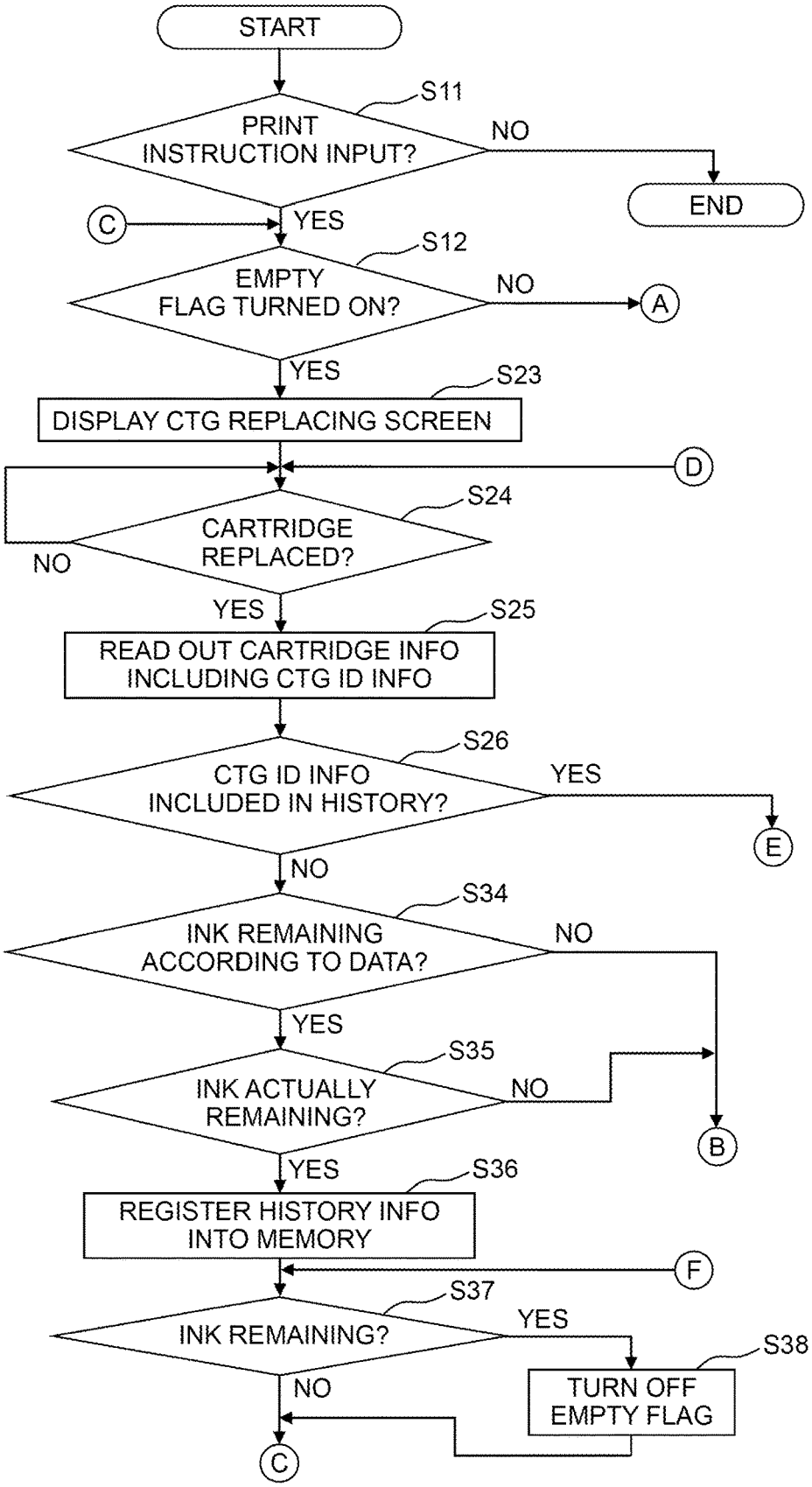
FIGS. 3A to 3C indicate a flow chart of a process executed by a control program.

As depicted in FIG. 3A, the control program 68 determines whether or not the cartridge 14 is replaced (S24). In particular, the control program 68 first displays the CTG replacing screen on the display 71 and then periodically acquires the detection value outputted by the installation sensor 43, so as to determine whether or not the cartridge 14 is replaced with reference to the periodically acquired detection value and a change in the detection value.

The control program 68 stands by until determining that the cartridge 14 is replaced (S24: No). If the control program 68 determines that the cartridge 14 is replaced (S24: Yes), then it reads out the cartridge information containing the model number, the CTG identification information, and the residual amount information from the CTG memory 55 of the IC chip 53 of the cartridge 14 via the cartridge I/F 44 (S25).

Then, the control program 68 determines whether or not the main memory 62 stores the history information having CTG identification information identical to the CTG identification information read out (S26). That is, in the step S26, the control program 68 determines whether or not the cartridge 14 installed in the installation case 41 is a cartridge 14 which was used in the printer 10 in the past.

If the control program 68 determines that the CTG identification information identical to the CTG identification information read out is stored in the main memory 62 (S26: Yes), then it determines (S27) whether or not the residual amount information included in the cartridge information indicates the amount showing that the ink is used up (zero, for example). That is, in the step S27, the control program 68 determines whether or not there is any ink remaining in the cartridge 14, on the basis of the data in the CTG memory 55.

If the control program 68 determines that there is ink remaining in the cartridge 14 on the basis of the data in the CTG memory 55 (S27: Yes), then the display 71 displays the notification screen (S28). That is, the notification screen is displayed on the display 71 if the cartridge 14 does not have the ink residual amount according to the data in the history information but does have the ink residual amount according to the data stored in the CTG memory 55. For example, if there are two cartridges 14 having identical CTG identification information and after the first cartridge 14 has used up the ink and thus been removed from the installation case 41, then if the second cartridge 14 is installed in the installation case 41, then the display 71 will display the notification screen (S28). That is, if the second cartridge 14 having the identical CTG identification information is used in the printer 10, then a problem will occur in the history management. In such a case, the notification screen is displayed on the display 71.

Figure 4B:
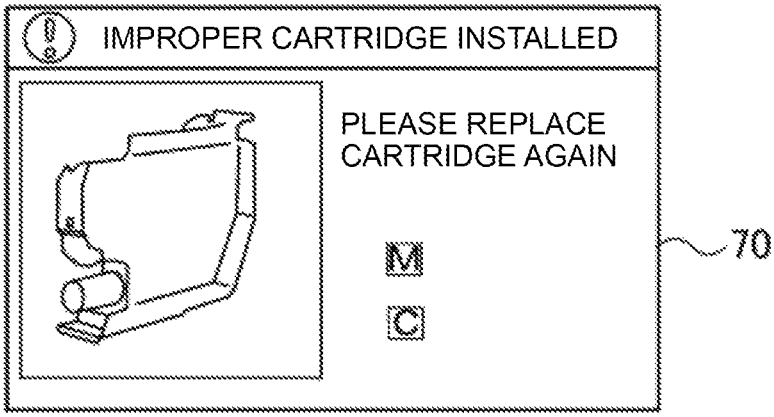
FIG. 4B depicts a notification screen.

As depicted in FIG. 4B, the notification screen includes the message "IMPROPER CARTRIDGE INSTALLED", the message "PLEASE REPLACE CARTRIDGE AGAIN", and a letter denoting the color of the ink stored in the cartridge 14 to be replaced. The user can watch the notification screen to realize that the cartridge 14 installed in the installation case 41 is an inappropriate one. Then, the user can remove the inappropriate cartridge 14 installed in the installation case 41 from the installation case 41, and then install another cartridge 14 into the installation case 41.

Figure 3B:
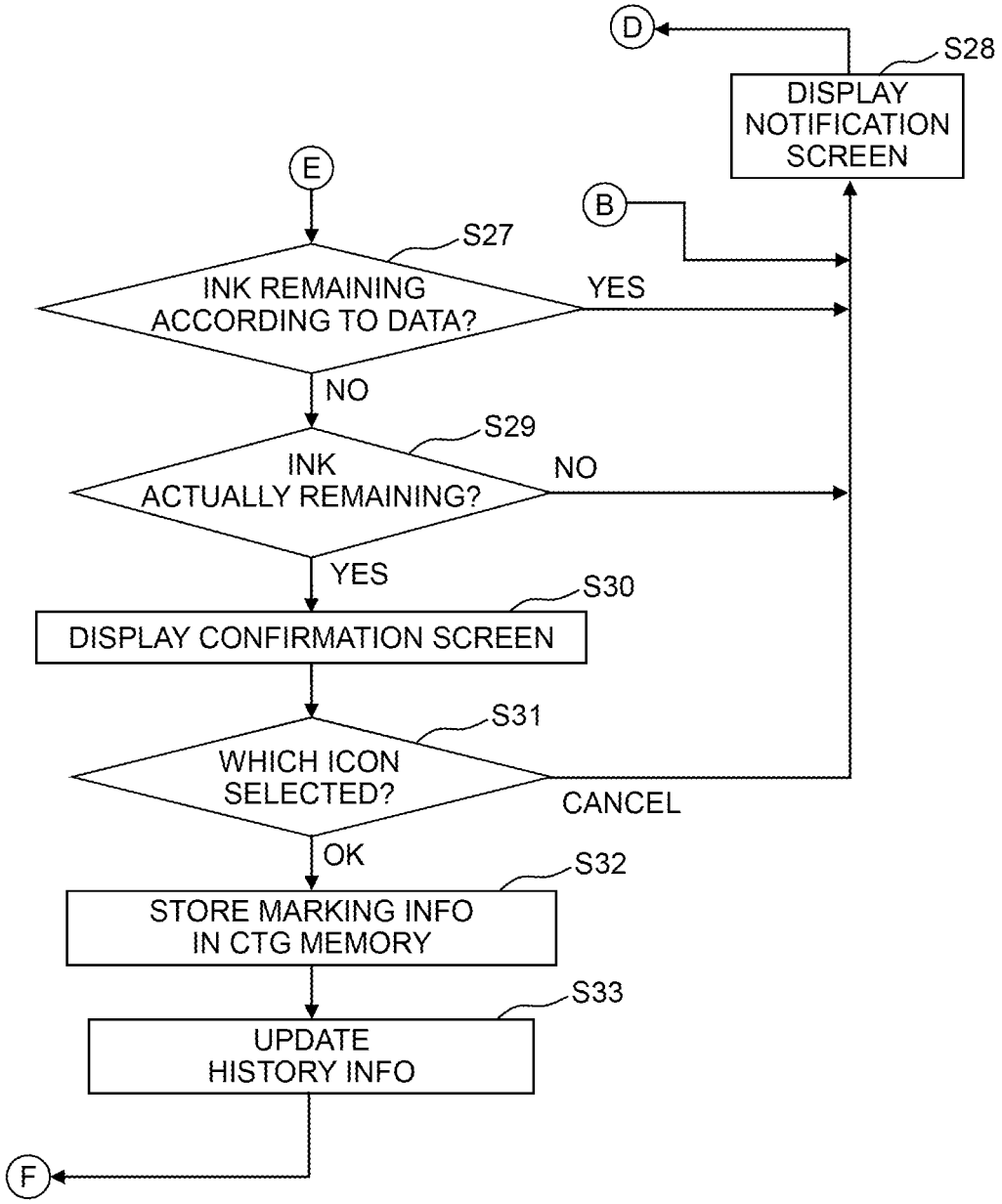
Figure 3C:
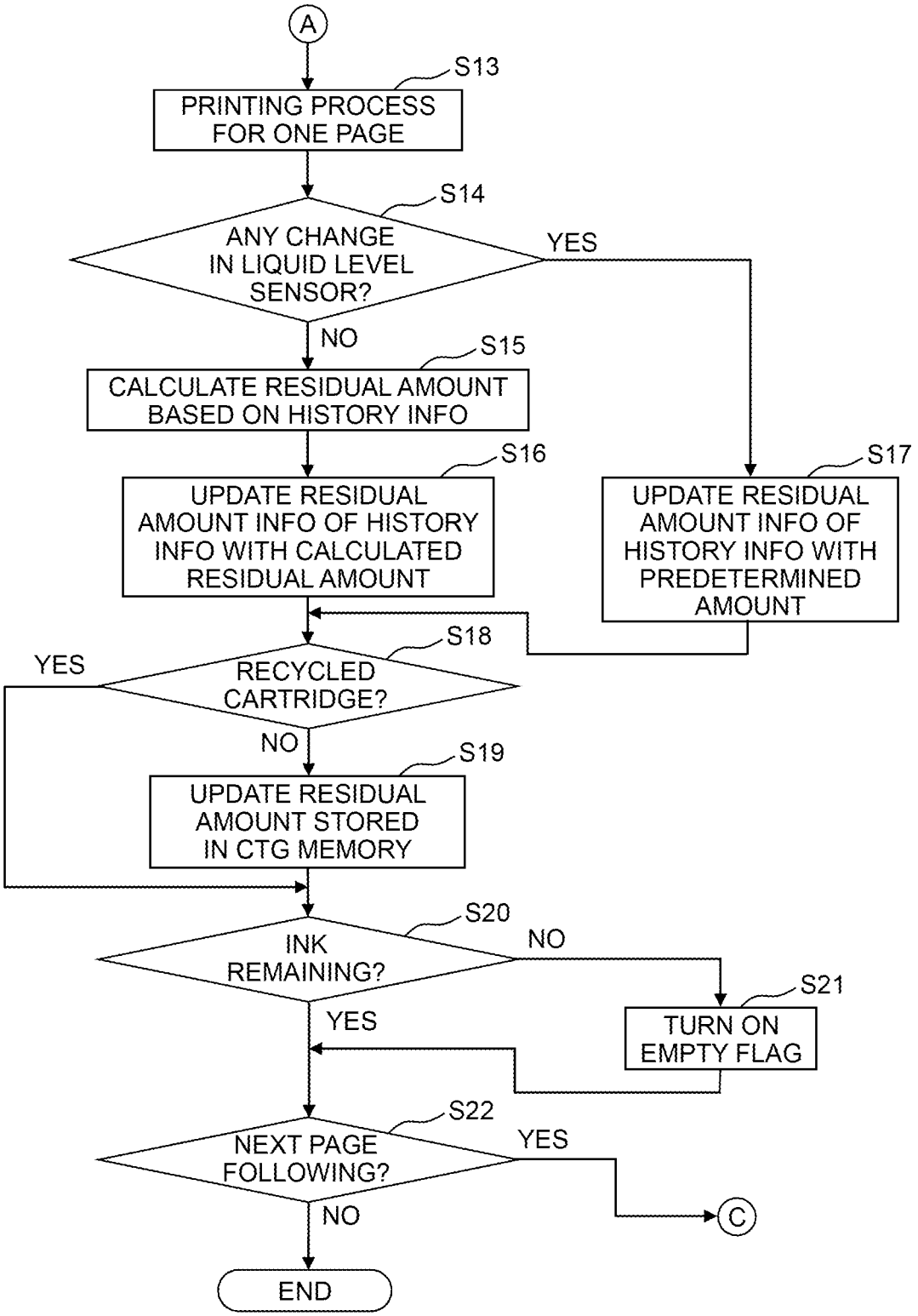

As depicted in FIG. 3B, if the control program 68 determines that there is no ink remaining on the basis of the data of the CTG memory 55 (S27: No), then it determines whether or not there is practically an ink residual amount (S29). To be explained in detail, if a cartridge 14 storing an ink is installed into the installation case 41, then the liquid level sensor 45 outputs a detection value indicating that the ink residual amount is not less than the predetermined amount. The control program 68 determines whether or not the cartridge 14 installed in the installation case 41 has practically stored the ink (S29) on the basis of the detection value outputted by the liquid level sensor 45.

If the control program 68 determines that there is practically no ink remaining in the cartridge 14 installed in the installation case 41 (S29: No), then it causes the display 71 to display the aforementioned notification screen (S28; FIG. 4B). For example, if an empty cartridge 14 removed from the installation case 41 is mistakenly reinstalled into the installation case 41, then the notification screen will be displayed on the display 71.

If the control program 68 determines that there is practically an ink remaining in the cartridge 14 installed in the installation case 41 (S29: Yes), then it causes the display 71 to display the confirmation screen (S30). For example, if the user inputs the ink to a cartridge 14 which was removed from the installation case 41, and then installs the same into the installation case 41, then the confirmation screen is displayed on the display 71. That is, if the cartridge 14 installed in the installation case 41 is a proper recycled cartridge with the ink inputted by the user, then the confirmation screen is displayed on the display 71. Note that the ink being inputted by the user is confirmed by the history information being stored in the main memory 62 (S26: Yes).

Figure 4C:
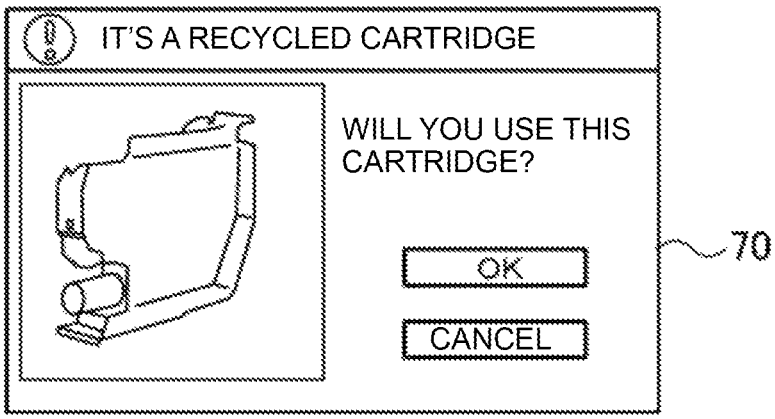
FIG. 4C depicts a confirmation screen.

As depicted in FIG. 4C, the confirmation screen has the message "IT'S A RECYCLED CARTRIDGE", the message "WILL YOU USE THIS CARTRIDGE?", an "OK" icon, and a "CANCEL" icon. The user can select the "OK" icon if he or she wants to use the cartridge 14 per se inputted with the ink. The user can select the "CANCEL" icon if he or she does not want to use the cartridge 14 inputted with the ink, then remove the cartridge 14 from the installation case 41, and finally install another cartridge 14 into the installation case 41.

The control program 68 determines whether the icon selected on the confirmation screen is the "OK" icon or the "CANCEL" icon (S31). If the control program 68 determines that the "CANCEL" icon is selected on the confirmation screen (S31: Cancel), then it causes the display 71 to display the aforementioned notification screen (FIG. 4B).

If the control program 68 determines that the "OK" icon is selected on the confirmation screen (S31: OK), then it causes the CTG memory 55 to store the marking information via the cartridge I/F 44 (S32). That is, the marking information is assigned to a proper recycled cartridge with the ink inputted by the user. The control program 68 causes the CTG memory 55 to store the last digit of the printer identification information stored in the main memory 62 as the marking information.

The marking information is used to determine whether or not there is a recycled cartridge in the aforementioned step S18 (FIG. 3C). To be explained in detail, the control program 68 accesses the CTG memory 55 via the cartridge I/F 44 in the step S18, to determine whether or not the marking information is stored in the CTG memory 55. Further, if the marking information is stored in the CTG memory 55, then the control program 68 reads out the marking information from the CTG memory 55 and determines whether or not the marking information read out is in agreement with the last digit of the printer identification information stored in the main memory 62. The control program 68 determines that the cartridge 14 installed in the installation case 41 is a recycled cartridge (S18: Yes) if the marking information is stored in the CTG memory 55 and the marking information stored in the CTG memory 55 is in agreement with the last digit of the printer identification information stored in the main memory 62. The control program 68 determines that the cartridge 14 installed in the installation case 41 is not a recycled cartridge (S18: No) for any other cases. Furthermore, if the control program 68 determines that the cartridge 14 installed in the installation case 41 is not a recycled cartridge (S18: No), then it carries out the aforementioned step S19. If the control program 68 determines that the cartridge 14 installed in the installation case 41 is a recycled cartridge (S18: Yes), then it skips the step S19.

As depicted in FIG. 3B, the control program 68 updates the residual amount information of the history information with the full residual amount information (S33) after carrying out the step S32. To be explained in detail, the main memory 62 stores beforehand a table associating the model number of the cartridge 14 with the full residual amount information. The control program 68 specifies the history information having the CTG identification information in agreement with the CTG identification information read out from the CTG memory 55 in the step S25, and specifies the full residual amount information associated with the model number of the specified history information in the above table. Then, the control program 68 updates the residual amount information of the history information with the specified full residual amount information. As described above, the ink residual amount displayed on the display 71 is based on the residual amount information of the history information. By carrying out the step S33, a proper ink residual amount is displayed on the display 71.

Note that in the step S33, the control program 68 may accept the input of residual amount information designated by the user and update the residual amount information of the history information with the accepted residual amount information designated. For example, the control program 68 causes the display 71 to display a residual amount input screen for accepting the input of residual amount information. The user can input the residual amount according to the ink amount inputted to the cartridge 14, following the instruction on the residual amount input screen. Alternatively, the user may select a residual amount icon indicating the residual amount according to the ink amount inputted to the cartridge 14 among a plurality of icons displayed on the residual amount input screen. The control program 68 updates the residual amount information of the history information (S33) with the residual amount inputted by the user or the residual amount indicated by the residual amount icon selected by the user.

Next, the control program 68 determines whether or not the residual amount information of the history information exceeds a threshold value stored in the main memory 62. That is, the control program 68 determines whether or not the ink residual amount is sufficient for printing (S37). If the control program 68 determines that the ink remaining therein is sufficient for printing (S37: Yes), then it turns off the empty flag (S38). Then, the control program 68 carries out the processes the step S12 and the steps thereafter. That is, it determines that the empty flag is turned off in the step S12 (S12: No), and carries out the printing process (S13). If the control program 68 determines that the ink residual amount is not sufficient for printing (S37: No), then it skips the step S38. That is, the empty flag is turned on as it is, and the printing process is not allowed.

If the control program 68 determines in the step S26 that the main memory 62 has not stored the history information having the CTG identification information identical to the CTG identification information read out in the step S25 (S26: No), then it determines whether or not there is ink remaining therein on the basis of the data of the CTG memory 55 (S34). The step S34 is carried out in the same manner as the step S27.

If the control program 68 determines that there is no ink remaining therein on the basis of the data of the CTG memory 55 (S34: No), then it causes the display 71 to display the aforementioned notification screen (S28; FIG. 4B). For example, if the installation case 41 is installed mistakenly with a cartridge 14 which was used in another printer and whose ink has been used up, then the notification screen is displayed on the display 71.

If the control program 68 determines that there is an ink remaining therein on the basis of the data of the CTG memory 55 (S34: Yes), then it determines whether or not there is practically any ink remaining in the cartridge 14 (S35). The step S35 is carried out in the same manner as the step S29.

If the control program 68 determines that there is practically no ink remaining in the cartridge 14 installed in the installation case 41 (S35: No), then it causes the display 71 to display the notification screen (S28; FIG. 4B). If the control program 68 determines that there is practically an ink remaining in the cartridge 14 installed in the installation case 41 (S35: yes), then it registers the history information into the main memory 62 (S36). In particular, the control program 68 causes the main memory 62 to store the model number of the cartridge information read out in the step S25, the CTG identification information and the residual amount information which are associated with each other. Further, the control program 68 causes the main memory 62 to store date information indicating the date which is information outputted by an unshown clock IC and which is associated with the cartridge information.

After registering the history information into the main memory 62, the control program 68 carries out the step 37 and the following steps.

Functions and Effects of the Embodiment

In this embodiment, if there is no ink according to the data of the CTG memory 55 (S27: Yes) and there is practically an ink remaining in the cartridge 14 (S29: Yes), then the control program 68 determines that the cartridge 14 installed in the installation case 41 is a recycled cartridge with the ink inputted anew. Further, if the history information has the CTG identification information identical to the CTG identification information of the cartridge 14 installed in the installation case 41 (S26: Yes), then the control program 68 determines whether or not the cartridge 14 installed in the installation case 41 is a proper recycled cartridge with the ink inputted by the user. That is, the printer 10 can determine whether or not the cartridge 14 installed in the installation case 41 is not only a recycled cartridge but also a proper recycled cartridge with the ink inputted by the user. Then, the printer 10 updates the residual amount information of the history information on the basis of the determination of the proper recycled cartridge (S33). That is, the printer 10 is not allowed to use any improper recycled cartridge for which the residual amount information of the history information is not updated. As a result, the printer 10 according to the present teaching can prevent malfunction from arising from any cartridge 14 which is made into a recycled use by another person than the user.

Further, in this embodiment, using the history information to manage the history of the cartridges 14, the liquid level sensor 45 for resetting the error accumulated in the ink residual amount, and the residual amount information stored in the CTG memory 55 capable of calculating the residual amount even when an cartridge 14 is used in another printer, the control program 68 determines whether or not the cartridge 14 installed in the installation case 41 is a proper recycled cartridge. That is, in this embodiment, by making use of the history information, the liquid level sensor 45 and the residual amount information of the CTG memory 55, the control program 68 determines whether or not the cartridge 14 installed in the installation case 41 is a proper recycled cartridge. Therefore, the printer 10 according to this embodiment can determine whether or not the cartridge 14 installed in the installation case 41 is a proper recycled cartridge without adding a new member to the printer 10 or a cartridge 14.

Further, in this embodiment, a cartridge 14 is recycled or reused by the user inputting the ink to the cartridge 14 whose ink residual amount became lower than a threshold value, and the recycled or reused cartridge 14 is reinstalled into the printer 10. With that, if the printer 10 determines that that cartridge 14 is a proper recycled cartridge, then the residual amount information of the history information is updated (S33). If the residual amount information of the history information is updated, then the empty flag is turned from being off to being on. As a result, the printer 10 is released from prohibition of printing. That is, the printer 10 can use a proper recycled cartridge. As a result, it is realized for the printer 10 to be capable of allowing the use of proper recycled cartridges which are made into recycled use by the user, but disallowing the use of any improper recycled cartridges.

Further, in this embodiment, if the cartridge 14 installed in the installation case 41 is not a recycled cartridge (S18: No), then the control program 68 updates the residual amount information stored in the CTG memory 55 (S19). Therefore, even if a cartridge 14 which was installed in the installation case 41 is reinstalled into another printer, the other printer is prevented from displaying the residual amount on the display and/or from carrying out a printing process to cause malfunction of the printer due to disregarding that there is no ink remaining. Further, if the cartridge 14 installed in the installation case 41 is a recycled cartridge (S18: Yes), then the residual amount information stored in the CTG memory 55 will not be updated. Therefore, the abovementioned other printer is prevented from any mistaken determination of an installed cartridge 14 being a new cartridge.

Further, in this embodiment, with the CTG memory 55 storing the marking information (S32), the printer 10 can determine whether or not the installed cartridge 14 is a recycled cartridge.

Further, in this embodiment, if the cartridge 14 installed in the installation case 41 is a proper recycled cartridge, then the control program 68 updates the residual amount information of the history information with the full residual amount information or updates the residual amount information of the history information with the residual amount inputted by the user (S33). Therefore, the printer 10 of this embodiment can display the residual amount on the display 71 after updating the residual amount information of the history information appropriately even if the cartridge 14 installed in the installation case 41 is a recycled cartridge.

Further, in this embodiment, the display 71 displays the confirmation screen (FIG. 4C) for accepting the selection of the user whether or not to use the recycled cartridge 14 (S30). Therefore, the printer 10 is prevented more reliably from malfunction due to using an improper recycled cartridge.

Modified Embodiments

In the above embodiment, such an example was explained that the control program 68 causes the installation sensor 43 to detect whether or not a cartridge 14 is replaced. However, the control program 68 may detect whether or not a cartridge 14 is replaced by testing whether or not the CTG memory 55 is accessible.

In the above embodiment, such an example was explained that the liquid level sensor 45 is provided to allow for detection of the ink level position in the cartridge 14. However, if the printer 10 has a container capable of storing the ink flowing out of the cartridge 14, then the liquid level sensor 45 may be provided to allow for detection of the ink level position in that container. In such case, the float 52 or the aforementioned prism is arranged in that container.

What is claimed is:

1. A printer comprising:

an installation case to which a cartridge is installed, the cartridge having a first memory storing cartridge information, the cartridge information including: cartridge identification information for identifying the cartridge; and residual amount information according to an amount of a print material stored in the cartridge;

a printing unit configured to perform printing by using the print material supplied from the cartridge installed in the installation case;

a cartridge interface configured to be communicable with the first memory in a case that the cartridge is installed in the installation case;

a second memory; and a controller configured to:

store history information in the second memory, the history information including the cartridge identification information and the residual amount information acquired from the first memory via the cartridge interface;

update the residual amount information of the history information based on information according to the amount of the print material discharged by the printing unit; and determine whether the cartridge installed in the installation case is a recycled cartridge, wherein in a case of determining that the cartridge installed in the installation case is not the recycled cartridge, the controller is configured to update the residual amount information stored in the first memory with the residual amount information after the history information is updated, and in case of determining that the cartridge installed in the installation case is the recycled cartridge, the controller is configured not to update the residual amount information stored in the first memory.

2. The printer according to claim 1, wherein the controller is configured to store marking information in the first memory via the cartridge interface based on determining that the cartridge installed in the installation case is a proper recycled cartridge, wherein in a case that the marking information is stored in the first memory, the controller is configured to determine that the cartridge installed in the installation case is the recycled cartridge, and wherein in a case that the marking information is not stored in the first memory, the controller is configured to determine that the cartridge installed in the installation case is not the recycled cartridge.

3. The printer according to claim 2, wherein printer identification information composed of a plurality of letters and/or numbers for identifying the printer is stored in the second memory, and the marking information includes part of the printer identification information.

4. The printer according to claim 1, further comprising a display and an input interface, wherein in a case that the cartridge installed in the installation case is determined as the recycled cartridge, the controller is configured to cause the display to display a confirmation screen for accepting selection of using or not using the cartridge installed in the installation case.

5. The printer according to claim 1, further comprising a sensor configured to output a detection value according to an amount of the print material stored in the cartridge installed in the installation case, wherein in a case that the cartridge is installed in the installation case, the controller is configured to determine that the cartridge installed in the installation case is a proper recycled cartridge and update the residual amount information of the history information, based on:

a) determining that the second memory stores the history information having the same cartridge identification information as the cartridge identification information acquired from the first memory;

b) determining that the residual amount information included in the history information is equal to or less than a threshold value stored in the second memory; and c) determining that the print material is stored in the cartridge installed in the installation case based on the detection value output from the sensor.

6. The printer according to claim 5, wherein the controller is further configured to: store, in the second memory, specific information indicating that the amount of the print material is equal to or less than the threshold value based on the residual amount information being equal to or less than the threshold value; and delete, change or update the specific information after updating the residual amount information of the history information based on determining that the cartridge installed in the installation case is the recycled cartridge.

7. The printer according to claim 5, wherein the controller is configured to update the residual amount information of the history information either with full residual amount information indicating the residual amount at the full level in the cartridge installed in the installation case, or with designated residual amount information indicating a designated residual amount.

8. The printer according to claim 5, wherein the cartridge has a box-like case storing ink as the print material, wherein the sensor has a light emitting unit configured to radiate light and a light receiving unit configured to receive the light radiated by the light emitting unit, wherein the cartridge further has a detection object for changing a light receiving condition of the light radiated by the light emitting unit and received by the light receiving unit, according to whether the ink amount is equal to or more than a predetermined amount, and wherein the sensor is configured to output different detection values between a case of the ink amount stored in the cartridge being equal to or more than the predetermined amount and a case of the ink amount stored in the cartridge being less than the predetermined amount.

9. The printer according to claim 8, wherein the light radiated from the light emitting unit proceeds in the case, and the detection object is disposed in the case and configured to change a position thereof according to a position of the liquid level of the ink.

10. The printer according to claim 8, wherein the light radiated from the light emitting unit proceeds in the case, and the detection object is disposed in the case and configured to change an optical path of the light according to a position of the liquid level of the ink.

11. The printer according to claim 8, wherein the light radiated from the light emitting unit proceeds in a container storing the ink having flowed out of the cartridge, and the detection object is disposed in the container and configured to change a position thereof according to a position of the liquid level of the ink.

12. The printer according to claim 8, wherein the light radiated from the light emitting unit proceeds in a container storing the ink having flowed out of the cartridge, and the detection object is disposed in the container and configured to change an optical path of the light according to a position of the liquid level of the ink.

13. A non-transitory medium storing a program to be installed in a printer comprising: an installation case to which a cartridge is installed, the cartridge having a first memory storing cartridge information, the cartridge information including: cartridge identification information for identifying the cartridge; and residual amount information according to an amount of a print material stored in the cartridge; a printing unit configured to perform printing by using the print material supplied from the cartridge installed in the installation case; a cartridge interface configured to be communicable with the first memory in a case that the cartridge is installed in the installation case; a second memory; and a controller, the program, when executed by the controller, causing the printer to:

store history information in the second memory, the history information including the cartridge identification information and the residual amount information acquired from the first memory via the cartridge interface;

specify new residual amount information based on the residual amount information and information according to the amount of the print material discharged by the printing unit; and update the residual amount information of the history information with the new residual amount information; and determine whether the cartridge installed in the installation case is a recycled cartridge, wherein in a case of determining that the cartridge installed in the installation case is not the recycled cartridge, the program causes the printer to update the residual amount information stored in the first memory with the residual amount information after the history information is updated, and in a case of determining that the cartridge installed in the installation case is the recycled cartridge, the program causes the printer not to update the residual amount information stored in the first memory.

14. The medium according to claim 13, wherein the printer further comprises a sensor configured to output a detection value according to an amount of the print material stored in the cartridge installed in the installation case, and wherein in a case that the cartridge is installed in the installation case, the program causes the printer to determine that the cartridge installed in the installation case is a proper recycled cartridge and to update the residual amount information of the history information, based on:

a) determining that the second memory stores the history information having the same cartridge identification information as the cartridge identification information acquired from the first memory;

b) determining that the residual amount information included in the history information is equal to or less than a threshold value stored in the second memory; and c) determining that the print material is stored in the cartridge installed in the installation case based on the detection value output from the sensor.

* * * * *